United States Patent [19]

Gittings

[11] 4,014,591

[45] Mar. 29, 1977

[54] COLLAPSIBLE CHAIR

[75] Inventor: Robert S. Gittings, Tiburon, Calif.

[73] Assignee: Gold Medal, Inc., Racine, Wis.

[22] Filed: Sept. 19, 1976

[21] Appl. No.: 706,509

[52] U.S. Cl. ..... 297/55; 297/441; 297/457; 297/57

[51] Int. Cl.[2] ..... A47C 4/00

[58] Field of Search ..... 297/55, 56, 57, 457, 297/93, 299, 351, 441

[56] References Cited

UNITED STATES PATENTS

| | | | |
|---|---|---|---|
| 2,587,543 | 2/1952 | Smith | 297/56 X |
| 2,691,410 | 10/1954 | Boucher | 297/57 X |
| 2,722,972 | 11/1955 | Altruda | 297/441 X |
| 3,901,551 | 8/1975 | Wiesner | 297/441 X |

FOREIGN PATENTS OR APPLICATIONS

| | | | |
|---|---|---|---|
| 213,007 | 1/1961 | Austria | 297/56 |

*Primary Examiner*—Roy D. Frazier
*Assistant Examiner*—Peter A. Aschenbrenner
*Attorney, Agent, or Firm*—James E. Nilles

[57] ABSTRACT

A collapsible chair providing a lightweight, strong, and sturdy chair when unfolded and providing a compact elongated structure when collapsed. The collapsible chair includes a fabric seat supported in suspended relationship at four corners by a frame assembly comprised of a plurality of legs pivotably connected together. The frame assembly includes a pair of pivotal crossed rear brace legs and a pair of pivotal crossed front brace legs joined by a pair of brace leg assemblies which define the opposite sides of the frame. The pair of brace leg assemblies each include three pivotally connected brace legs, two of these brace legs of each pair of assemblies being connected by a pivotable stop link which permits relative pivotal movement of these brace legs and provides a means for restraining the three brace legs in their proper positions when the chair is in its open position. The ends of the pivotally crossed rear brace legs and the ends of the pivotally crossed front brace legs are pivotally joined to the side frame assemblies by angular brackets which permit simultaneous relative pivotal movement of the two connected brace legs about perpendicular axes, and thereby facilitating collapse of the chair in two dimensions simultaneously to form an elongated compact assembly of nearly parallel brace legs.

4 Claims, 9 Drawing Figures

COLLAPSIBLE CHAIR

BACKGROUND OF THE INVENTION

The present invention relates to a collapsible chair and more particularly to a chair which includes a plurality of pivotably joined legs and a flexible seat formed of fabric or the like and supported by the legs.

Collapsible chairs are intended to provide a strong, stable chair when unfolded but form a compact assembly when collapsed to thereby permit convenient transport and storage. It is further advantageous that the chair be relatively lightweight and have a sturdy relatively simplified construction.

SUMMARY OF THE INVENTION

The present invention comprises an improved collapsible chair which provides a large and sturdy, firmly supported chair when the chair is in an unfolded position but which can be collapsed to form a compact lightweight unit.

The collapsible chair of the invention generally comprises a fabric seat which can be supported at each of four corners by a collapsible frame formed by a plurality of relatively pivotable brace legs. The legs comprising the frame include a front pair of crossed pivotally joined legs and a rear pair of crossed pivotally joined elongated legs. The front and rear pairs of crossed pivotable legs are joined by two side frame assemblies each comprised of three pivotally connected brace legs.

Each of the opposite ends of the brace legs of both the front and rear pair of crossed brace legs are joined to the respective side frame assemblies by angular connector brackets which function to facilitate a simultaneous collapse of the chair in both the lateral and fore and aft directions, the angular connector brackets facilitating relative pivotal movement of the ends of the connected brace legs about two perpendicular axes simultaneously. The side frame assemblies each include a pivotable stop link pivotably connecting two of the brace legs of the side frame and restricting the extent of opening the chair. The pivotable stop links function to give the side frame assemblies rigidity when they are in their open position and prevent further opening of the seat to thereby lend structural stability to the chair. The pivotal stop links have the advantage of having a relatively uncomplicated construction and facilitating folding of the chair into a compact bundle.

An advantage of the collapsible chair of the invention is that though the chair, when in an unfolded useful position, provides a large comfortable seat which is strong and sturdy, the chair can be easily folded into a collapsed position wherein it comprises a very compact elongated bundle which can be easily stored or conveyed. Furthermore, though the chair is strong and durable when in the unfolded position, the design of the chair is such that it does not require structural components which are cumbersome or heavy but instead includes a plurality of relatively lightweight narrow brace legs which can be folded into a compact lightweight bundle.

A further advantage of the present invention is that the angular connector brackets used to pivotably connect the various brace legs of the chair are identical. This facilitates manufacturing and reduces the potential cost of the chair.

Further advantages of the collapsible chair of the invention will be seen from the following description of one preferred embodiment of the invention.

DESCRIPTION OF THE PREFERRED EMBODIMENT

Figure 1:
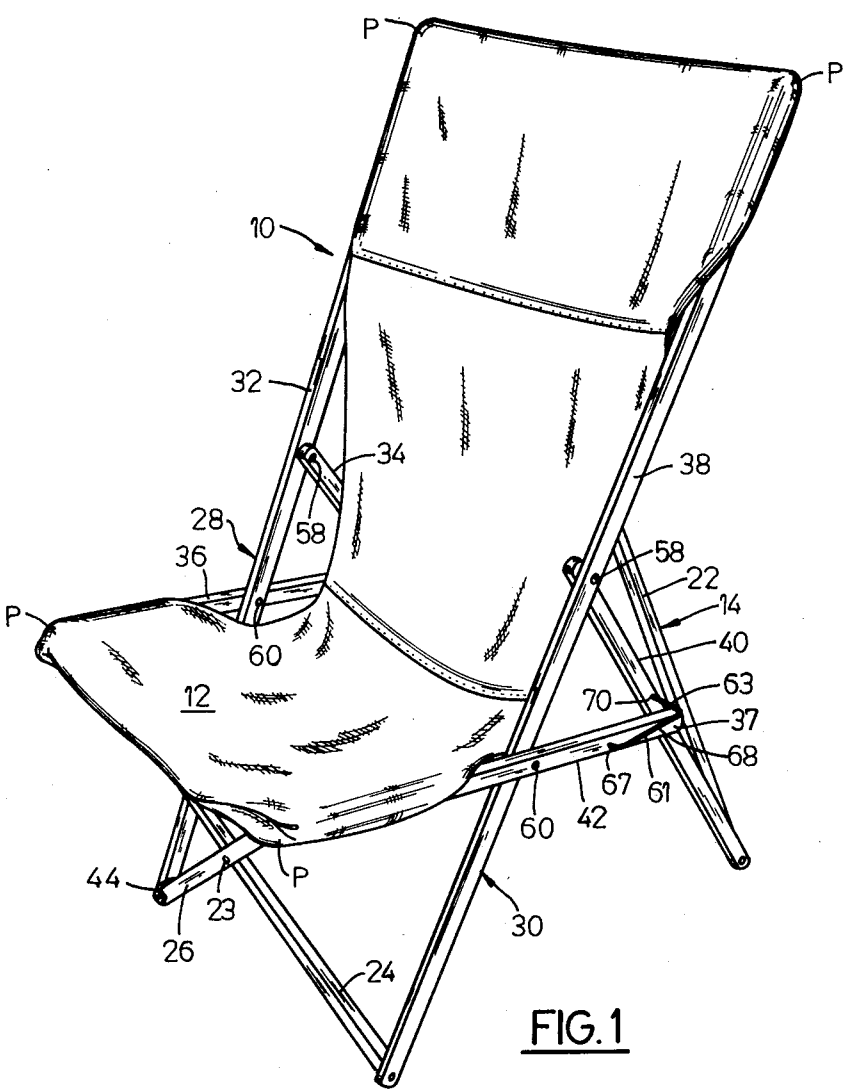
FIG. 1 is a perspective view of the collapsible chair of the present invention in opened relation.
Figure 8:
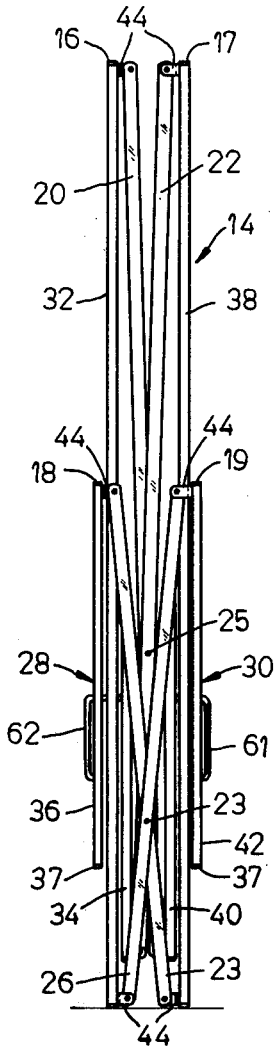
FIG. 8 is a view taken along line 8—8 in FIG. 7.

The collapsible chair 10 of the present invention is shown in FIG. 1 as including a seat 12 comprised of fabric, canvas or the like, and a collapsible frame assembly 14 which can be opened to assume the position shown in FIG. 1 to thereby comprise a stable rigid chair or be folded to form a compact collapsed structure such as that shown in FIG. 8. The seat 12 comprises a generally rectangular piece of fabric which includes pockets P at each of its four corners. The pockets P are intended to be received over the corners 16, 17, 18, and 19 of the frame assembly such that the seat 12 is supported by these corners 16–19 in generally suspended relationship to thereby provide a relatively large comfortable seat.

Figure 2:
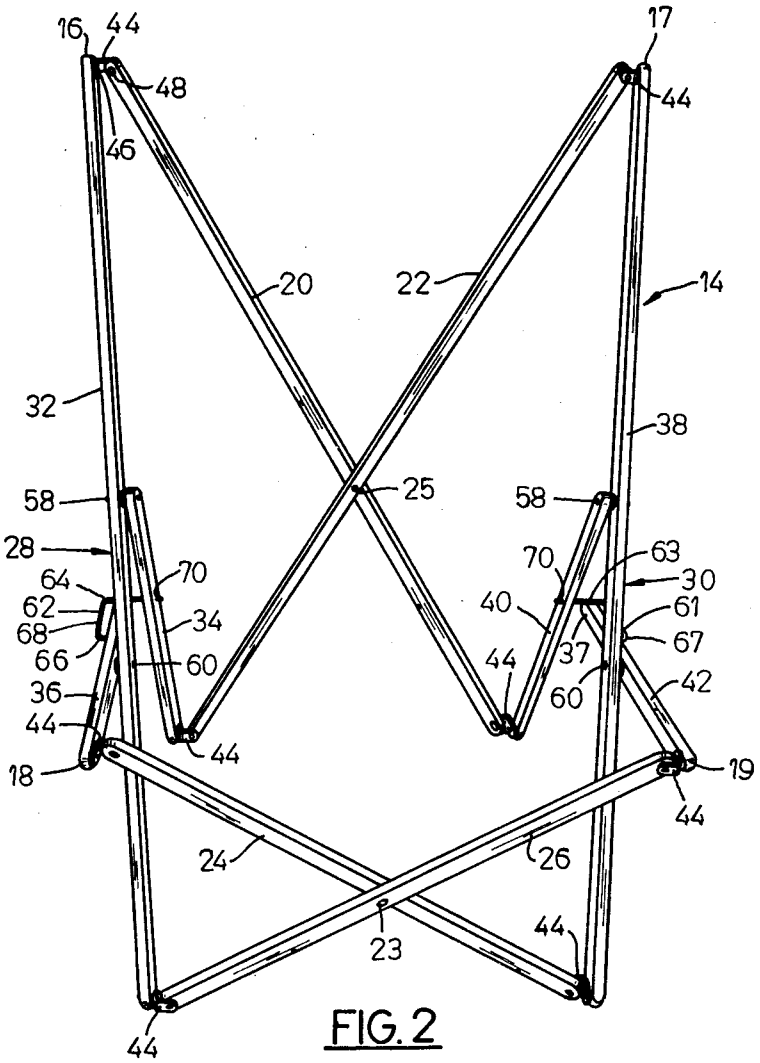
FIG. 2 is a front perspective view of the chair shown in FIG. 1 but with the fabric seat removed.

The collapsible frame assembly 14, as shown in FIG. 2, comprises a rear pair of crossed vertical brace legs 20 and 22, a front pair of crossed vertical brace legs 24 and 26 and two side frame assemblies 28 and 30. The front two brace legs 24 and 26 and the rear two brace legs 20 and 22 are pivotably connected intermediate their lengths by bolts, or the like, 23 and 25, respectively. The bolts 23 and 25 are positioned such that the two pairs of brace legs are pivotable about points which lie in a vertical plane which longitudinally bisects the chair and such that as the legs pivot about the bolts 23 and 25 the brace legs comprising each pair of crossed members will collapse toward each other in a scissor-like motion whereby the chair can be collapsed toward the vertical plane longitudinally bisecting the chair.

Figure 3:
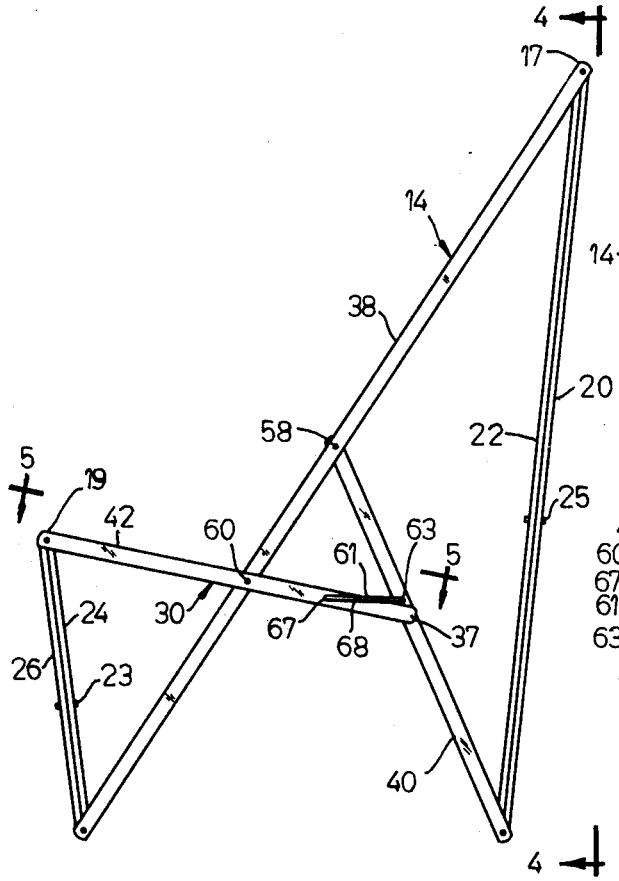
FIG. 3 is a side elevation view of the seat shown in FIG. 2.

The side frame assembly 28 is comprised of three pivotably connected brace legs 32, 34, and 36. Similarly, the side frame assembly 30 is comprised of three pivotably connected brace legs 38, 40, and 42. As shown in FIG. 3, the brace leg 38 of the side frame assembly 30 is generally vertical and inclined rearwardly and its upper end is pivotably connected to the upper end of the rear vertical brace leg 22 to form the frame corner 17. The brace leg 40 is also generally vertical and inclined forwardly when the chair is in an open position, and the lower end of the brace leg 40 is pivotably connected at its lower end to the lower end of brace leg 20. The upper end of the brace leg 40 is pivotably connected by a bolt or rivet 58 to the brace leg 38 intermediate the ends of the brace leg 38. The brace leg 34 of the side frame assembly 28 is similarly connected between the lower end of the brace leg 22 and the brace leg 32.

Figure 5:
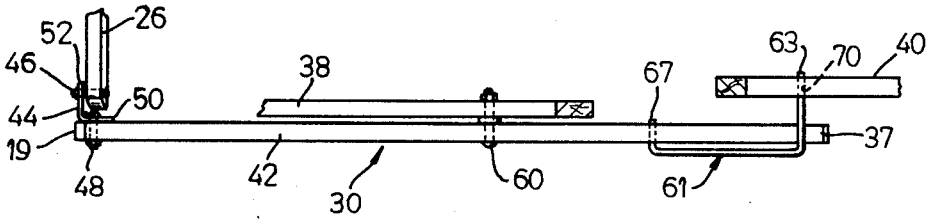
FIG. 5 is a view taken along line 5—5 in FIG. 3.
Figure 6:
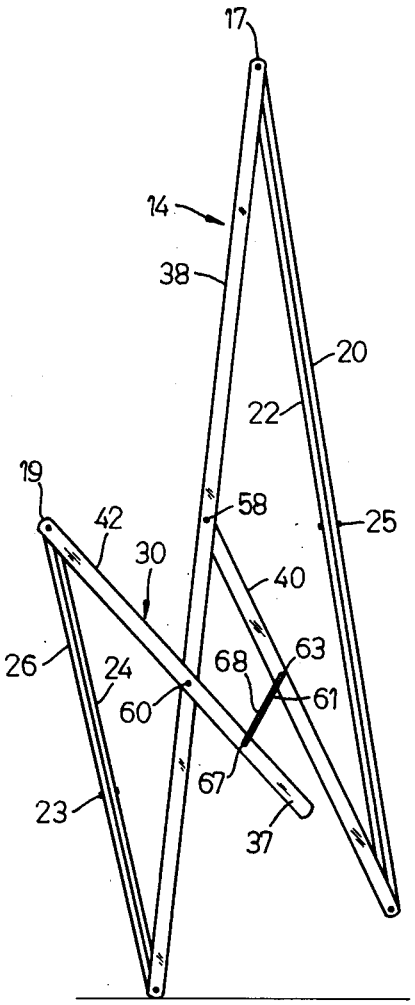
FIG. 6 is a view similar to that shown in FIG. 3 but with the chair in partially collapsed position.
Figure 7:
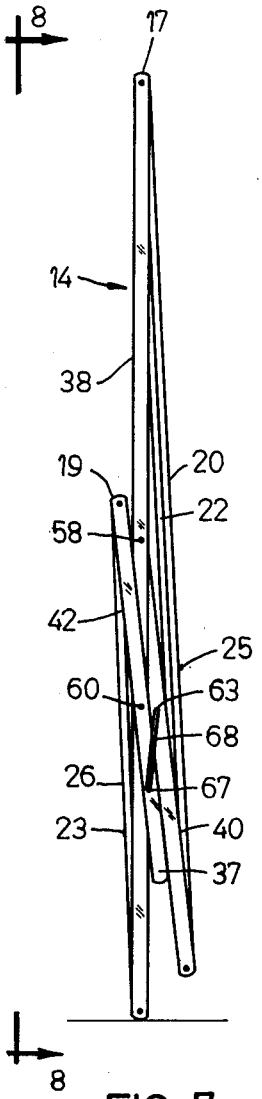
FIG. 7 is a view similar to those of FIGS. 3 and 6 but showing the chair in a completely collapsed position.

The brace leg 42 of the side frame assembly 30 is generally horizontally disposed when the chair is open and is pivotably connected at its forward end to the upper end of the brace leg 26. The brace leg 42 is further pivotably supported at a point intermediate its length by a bolt or rivet 60 which extends therethrough and through the brace leg 38 at a point intermediate its lower end and the bolt 58. The rearwardly extending free end 37 (FIG. 3) is operably connected to the brace leg 40 by an angular pivotal stop link 61. The angular pivotal stop member 61 is comprised of an angular U-shaped wire or rod bent to form two parallel spaced apart projecting shafts or ends 63 and 67 which are joined by an integral connecting shaft 68. As best seen in FIG. 5, the elongated projecting end 63 extends laterally inwardly toward the longitudinal center of the chair through a bore 70 in the brace leg 34 intermediate its ends and is pivotable therein. The other projecting end 67 of the angular stop member 61 similarly extends toward the longitudinal center of the chair and is pivotably received in a bore in the free end 37 of the brace leg 42.

The side frame assembly 28 is constructed in the same manner as the side frame assembly 30 and further includes a pivotal stop member 62 including projecting ends 64 and 66 and an intermediate connecting portion 69.

As shown in FIG. 3, the ends of the free ends 37 of the brace legs 36 and 42 are receivable underneath the projecting shafts 63 and 64 of the stop members 61 and 62 such that the stop members limit the extent of pivotal movement of the respective brace legs 36 and 42 about the bolt 62 when the collapsible chair has been opened. The pivotal stop members 61 and 63 also function to restrict the extent of angular movement of the brace legs 38 and 40 of the side frame assembly 30 and brace legs 32 and 34 of the side frame assembly 28 thereby preventing collapse of the chair.

Figure 9:
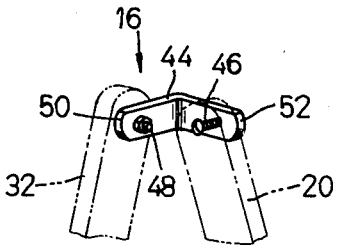
FIG. 9 is an enlarged perspective view of one of the angular connectors shown in FIGS. 2, 4, 5, and 8.

In order to facilitate simultaneous collapse of the frame assembly 14 both laterally and in the fore and aft directions, each of the opposite ends of the crossed brace legs 20, 22, 24 and 26 is pivotably connected to one of the brace legs of the side frame assemblies 28 or 30 by angular brackets 44. These angular brackets 44 connect the respective ends of the brace legs so as to permit relative movement between the brace legs simultaneously about two perpendicular pivot axes. In order to accomplish this, the brackets 44 each include a pair of integrally connected perpendicular flat members 50 and 52 (FIG. 9), each of these members including a bore therein for receiving bolts 48 and 46, respectively. As an example of the pivotal connection provided by the angular brackets 44, FIGS. 2 and 9 show a bracket 44 used to pivotably secure the ends of the brace legs 32 and 20 together. As shown therein, the flat member 50 of the angular bracket 44 is secured against the inside surface of the upper end of the brace leg 32 and is pivotably connected thereto by the bolt 48. Similarly, the flat member 52, integrally connected to the flat member 50, is pivotably connected to the rearward surface of the brace leg 20 by a bolt 48. When the chair is folded into a collapsed position, the brace leg 32 can pivot about a lateral axis through the center line of bolt 48 and the brace leg 20 can simultaneously pivot about a perpendicular longitudinal axis of the bolt 48. It will be noted that the ends of the brace legs 20, 22, 24 and 26 are each received adjacent the internal angle of the angular bracket 44.

Figure 4:
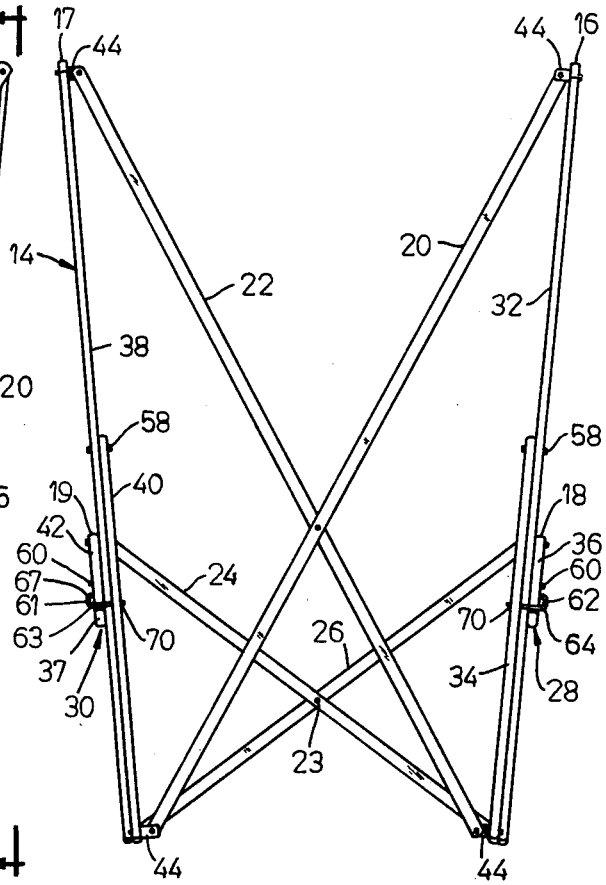
FIG. 4 is a view taken along line 4—4 in FIG. 3.

When the frame assembly 14 is folded from the position shown in FIGS. 2, 3 and 4 to the position shown in FIG. 8, the rear crossed brace legs 20 and 22 and the front crossed brace legs 24 and 26 pivot in scissor-like relationship about the bolts 23 and 25. As a result of this pivotal movement, the ends of these brace legs 20, 22, 24 and 26 pivot about the bolts 46. Furthermore, as the front two legs 24 and 26 collapse toward each other and their ends become further vertically separated, the forward ends of the brace legs 36 and 32 and the forward ends of the brace legs 38 and 34 are also caused to separate vertically such that these brace legs pivot in a scissor-like manner. As the rearward ends of the brace legs 36 and 42 are thus caused to move downwardly and toward the lower ends of the brace legs 32 and 38, respectively, the angular stop members 61 and 62 pull the brace legs 34 and 40 and the lower ends of the brace legs 20 and 22 toward the lower ends of brace legs 32 and 38. The frame is thus caused to collapse simultaneously into a narrow elongated unit.

Resume

The collapsible chair of the present invention thus provides a relatively large and comfortable chair when positioned in an open position yet comprises a chair which can be collapsed to form a very compact lightweight structure which can be easily stored. The compactness of the structure is provided by the particular arrangement of the brace legs and by providing angular connector brackets for joining the ends of the brace legs thereby permitting pivotal movement of the brace legs about two perpendicular axes simultaneously. The angular stop member described above in combination with the particular arrangement of brace legs provides a sturdy, uncomplicated, but effective means for supporting the chair in its open position.

I claim:

1. A collapsible chair foldable from an unfolded position into an elongated compact structure and being simultaneously collapsible in two dimensions, the collapsible chair comprising:

a front pair of crossed brace legs, each of said brace legs having an upper end and a lower end and being pivotably connected to each other intermediate their ends;

a rear pair of crossed brace legs, each of said rear brace legs having an upper end and a lower end being pivotably connected to each other intermediate their ends;

a pair of laterally spaced apart side assemblies connecting the front and rear pairs of crossed brace legs, each of said side assemblies including (1) a first brace leg having an upper end and a lower end, said upper end being pivotably connected to an upper end of one of said cross brace legs of said rear pair of crossed brace legs and said lower end pivotably connected to a lower end of one of said crossed brace legs of said front pair of crossed brace legs, (2) a second brace leg having an upper end pivotably connected to said first brace leg intermediate the length of the latter and also having a lower end pivotably connecting to a lower end of one of said crossed brace legs of said rear pair of crossed brace legs, (3) a third brace leg having opposite ends, one of said opposite ends being pivotably connected to said upper end of one of said crossed brace legs of said front pair of crossed brace legs and (4) a pivotable stop link pivotally connected between the other of said opposite ends of said third brace leg and said second brace leg intermediate the length of the latter, and a fabric seat supported in suspended relationship by said brace legs.

2. The collapsible chair set forth in claim 1 further including a plurality of angular connector brackets for pivotably connecting said front pair of crossed brace legs and said rear pair of crossed brace legs to the spaced apart side assemblies, each of said angular connector brackets connecting one of said ends of said cross brace legs to one of said brace legs of the spaced apart side assemblies for simultaneously pivotable movement about perpendicular axes.

3. The collapsible chair set forth in claim 2 wherein each of said angular connecting brackets includes a first flat member and an integrally connected second flat member, said members being relatively disposed in perpendicular relationship, and further including a first pivot shaft pivotably connecting said first flat member to one of said crossed brace legs and a second pivot shaft pivotably connecting the second flat member to an end of another of said brace legs, said first and second shafts being perpendicular.

4. The collapsible chair set forth in claim 1 wherein said pivotable stop link includes a first shaft portion pivotably connected to said second brace leg intermediate the length of the latter and a second shaft connected to said first shaft and having an end pivotably connected to said other end of said opposite ends of said third brace leg, said shafts being parallel and in spaced apart relationship, and the other of said ends of said third brace leg positionable below said first shaft when said collapsible chair is in an unfolded position and supported in abutting engagement against said first shaft.

* * * * *